United States Patent [19]

Stroup

[11] Patent Number: 4,493,500

[45] Date of Patent: Jan. 15, 1985

[54] DEAD BOLT AND NIGHT CHAIN COMBINATION

[76] Inventor: Larry J. Stroup, 10 Clark Rd., Oswego, Ill. 60543

[21] Appl. No.: 478,711

[22] Filed: Mar. 25, 1983

[51] Int. Cl.[3] ..... E05C 17/36

[52] U.S. Cl. ..... 292/262

[58] Field of Search ..... 292/191, 192, 262, 264, 292/341.17; 70/DIG. 49, 93

[56] References Cited

U.S. PATENT DOCUMENTS 1,988,049 1/1935 Reiner ..... 292/264

4,087,121 5/1978 Davis ..... 292/341.17 X

FOREIGN PATENT DOCUMENTS 476869 12/1952 Italy ..... 292/264

*Primary Examiner*—Richard E. Moore

*Attorney, Agent, or Firm*—Harvey B. Jacobson

[57] ABSTRACT

The sliding deadbolt of a security door lock internally mounts a latching device engageable with the coupling element on the end of a flexible guard element retracted within a jamb-mounted, strike housing into which the deadbolt is projected for door locking purposes. Retraction of the deadbolt permits opening of the door to a limited extent by extension of the guard element from the strike housing in the jamb. Continued retraction of the deadbolt effects release of the latch device and retraction of the guard element.

33 Claims, 21 Drawing Figures

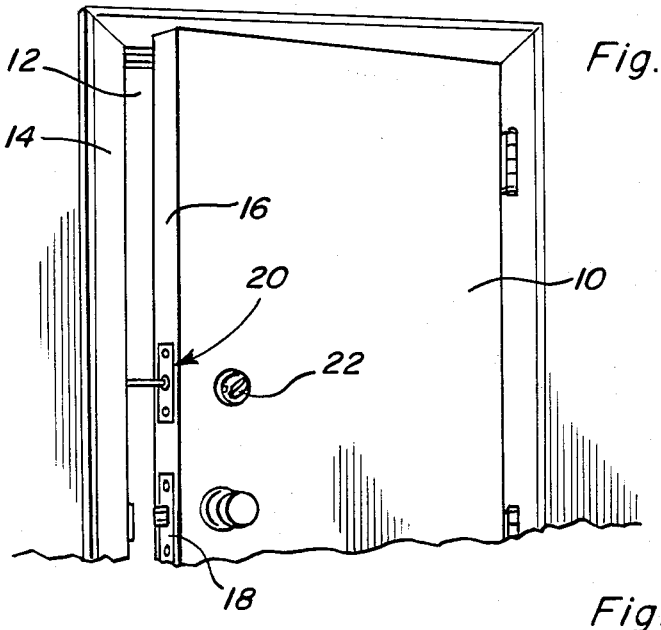
Fig. 1
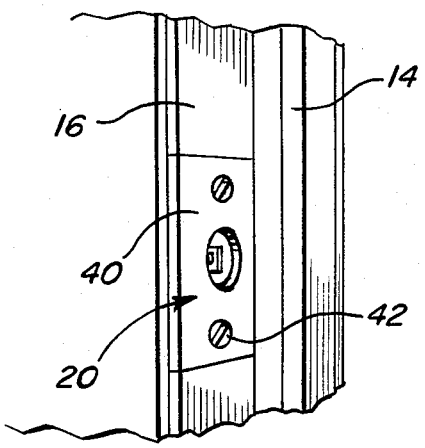
Fig. 2
Fig. 3
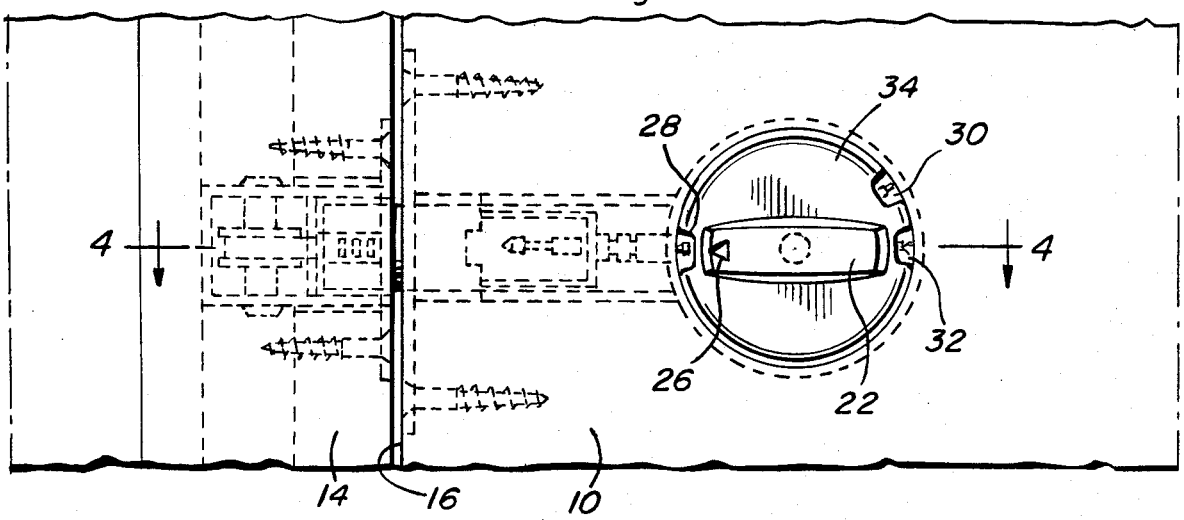
Fig. 4
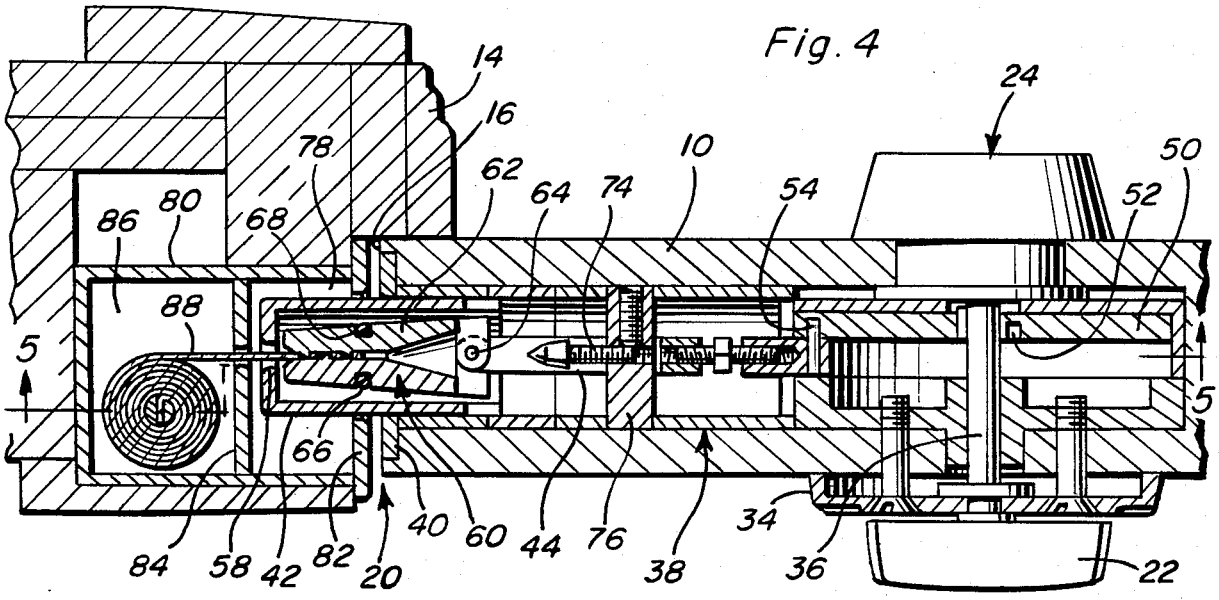

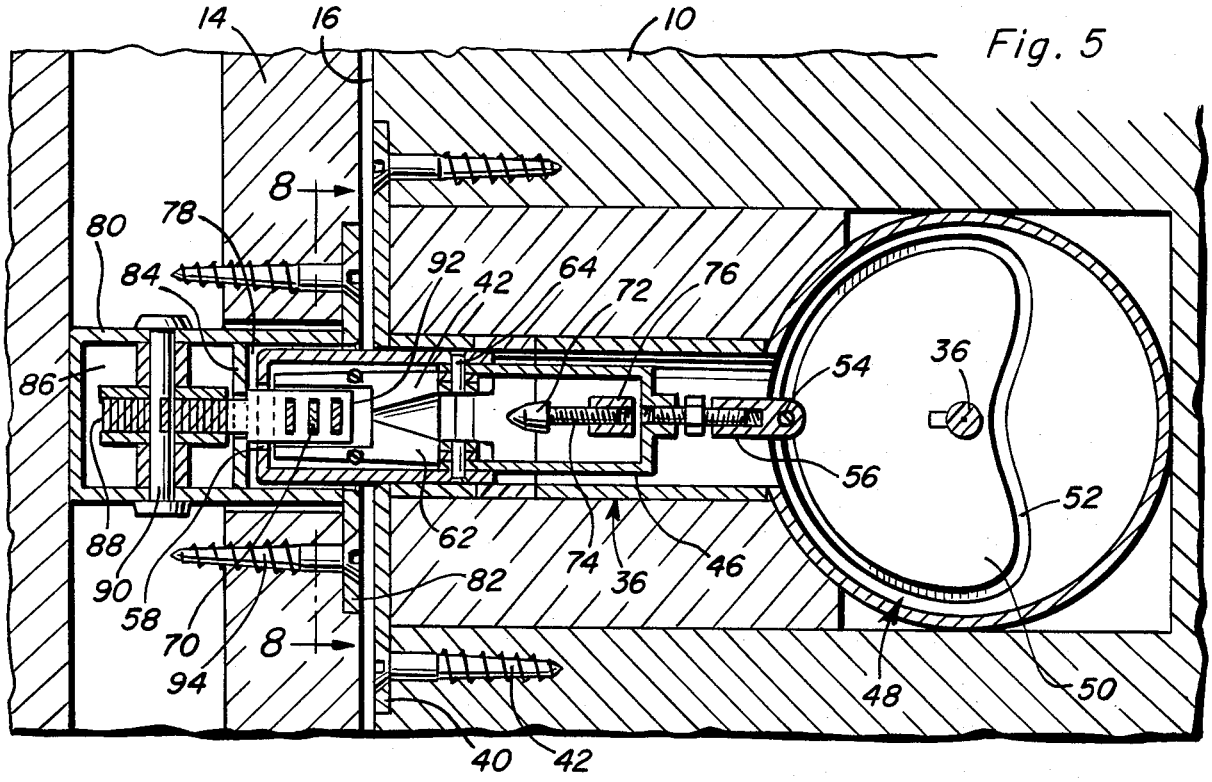
Fig. 5
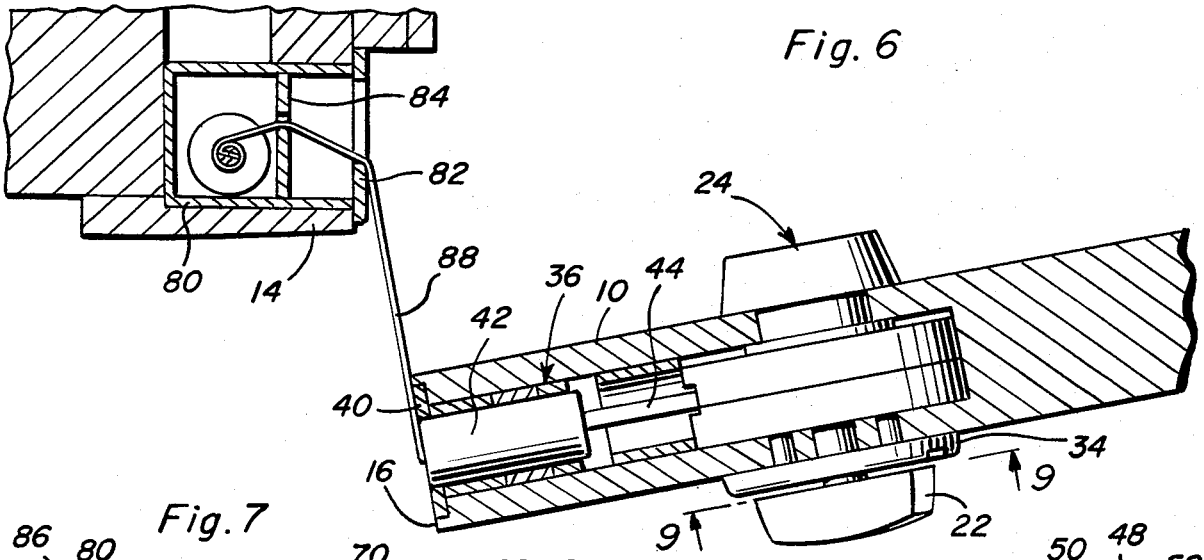
Fig. 6
Fig. 7
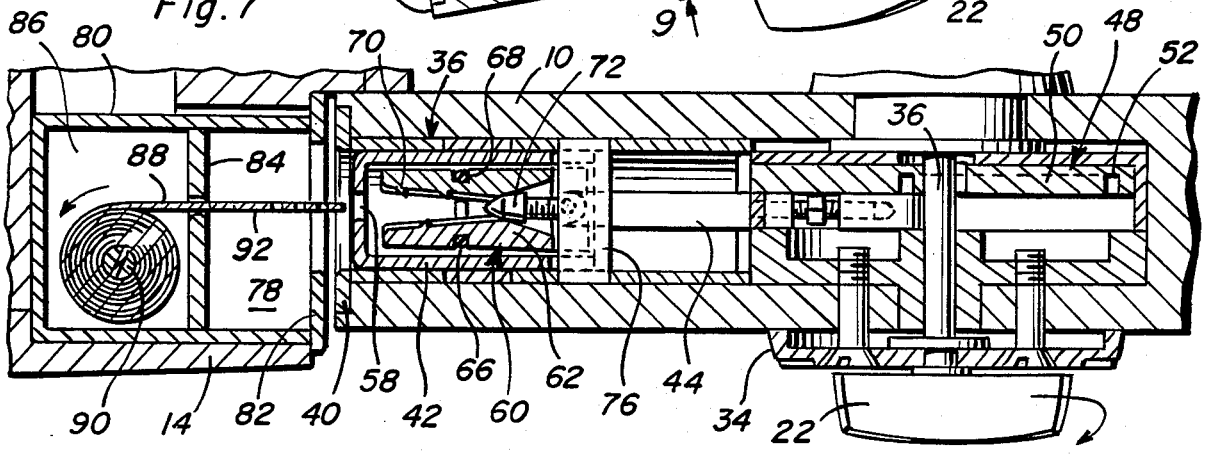

DEAD BOLT AND NIGHT CHAIN COMBINATION

BACKGROUND OF THE INVENTION

This invention relates to security door lock arrangements having incorporated therein a flexible guard element through which the door may be partially opened.

Safety door lock assemblies having a flexible guard chain incorporated therein are already well known as disclosed for example in U.S. Pat. No. 2,946,213 to Reiner. In the foregoing type of security door lock assembly, a manually operable door lock controlled from one side through a knob for example, releases either the lock alone or both the lock and the guard chain through separate operation. A rather complex mechanism is associated with such an arrangement whereby locking of the door is accomplished through a releasable latching mechanism while a separate releasable latching mechanism is associated with the guard chain. Unlocking of the door alone will permit opening of the door to a limited extent determined by the guard chain which remains latched to the door while extended against a spring bias from storage within the stationary jamb-mounted hardware with which the door mounted hardware cooperates.

It is therefore an important object of the present invention to provide a combination door lock and releasable flexible guard element of the foregoing type which is simpler in construction and easier to control.

SUMMARY OF THE INVENTION

In accordance with the present invention, a retractable flexible guard element stored within jamb-mounted striker hardware is latched to the door mounted hardware through a latch device carried by a deadbolt associated with the security door lock arrangement. A manually operable actuating mechanism is arranged to effect retraction of the deadbolt to a first position in which the flexible guard element remains latched thereto. Without any separate door reclosing operation, the actuating mechanism may be displaced to a second retraction position in which the latch for the flexible guard element is released. The latch device mounted within the deadbolt is furthermore arranged to reengage the flexible guard element through an end coupling element when the door is closed and the deadbolt is extended to its locking position. Any attempt at forced entry is detected by an impact sensing arrangement to trigger an alarm according to certain embodiments of the invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 1 a partial perspective view illustrating a typical door installation for one embodiment of the present invention, with the door partially opened.

FIG. 2 is a partial perspective view illustrating the installation of FIG. 1 with the lock fully released.

FIG. 3 is a side elevational view of a portion of the installation shown in FIG. 1 with the door in a closed and locked position.

FIG. 4 is an enlarged partial section view taken substantially through a plane indicated by section line 4—4 in FIG. 3.

FIG. 5 is a section view through a vertical plane indicated by section line 5—5 in FIG. 4.

FIG. 6 is a section view in a horizontal plane through the door shown in FIG. 1 in an open position limited by the flexible chain associated with the security lock assembly.

FIG. 7 is a horizontal section view similar to that of FIG. 4 but showing the lock assembly in a flexible guard element release position with the door closed.

DETAILED DESCRIPTION OF PREFERRED EMBODIMENTS

Figure 10:
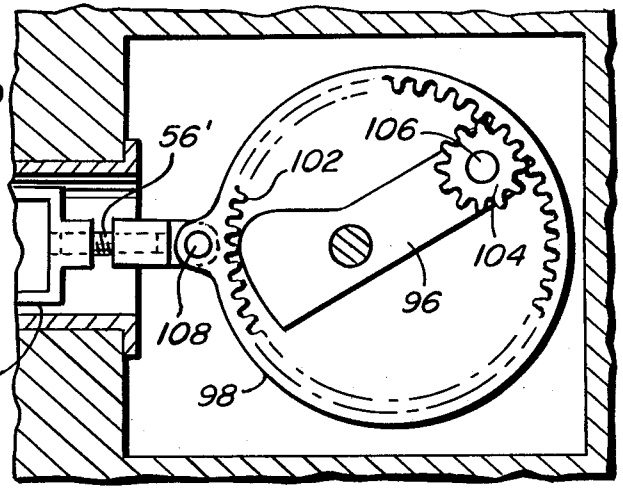
FIG. 10 is a partial section view in a vertical plane corresponding to that of FIG. 5 but illustrating a modification in accordance with another embodiment of the invention.
Figure 9:
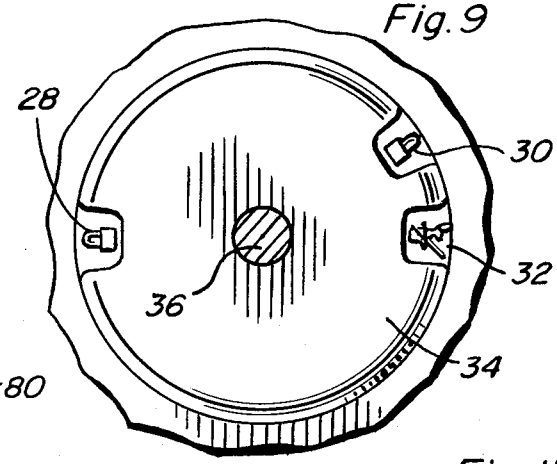
FIG. 9 is a partial section view taken substantially through a plane indicated by section line 9—9 in FIG. 6.
Figure 8:
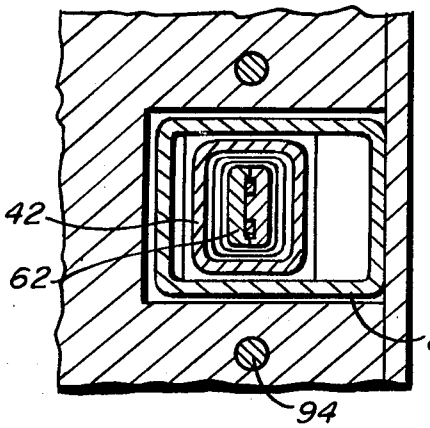
FIG. 8 is a transverse section view taken substantially through a plane indicated by section line 8—8 in FIG. 5.

Referring now to the drawings in detail, FIG. 1 illustrates a typical installation for the present invention involving a door 10 hingedly mounted within a framed doorway 12. The stationary door way frame includes a vertical jamb 14 which confronts the door edge 16 opposite the hinged door edge. A standard latch type lock assembly 18 is shown mounted in the door below a security deadbolt lock assembly 20 with which the present invention is associated. The lock assembly 20 includes a standard manually operated thumb knob 22 on one side of the door associated with a turn key lock mechanism 24 as more clearly seen in FIG. 4. In accordance with the present invention, an index indicator marking 26 is placed on the knob 22 for alignment with three position markings 28, 30 and 32 on a circular escutcheon 34 through which a lock shaft 36 extends from the knob 22 into the lock receiving cavity formed in the door. The position markings 28, 30 and 32 as shown in FIGS. 3 and 9, denote deadbolt extension, retraction and latch release positions, respectively.

Referring now to FIGS. 4 and 5 in particular, the movable door portion of the lock assembly in accordance with one embodiment of the invention includes a tubular housing assembly generally referred to by reference numeral 36 fitted into a cylindrical bore formed in the door and connected at one axial end to a face plate 38 through which the housing is secured to the door by means of flathead screw fasteners 40. The tubular housing 36 slidably mounts a tubular deadbolt member 42. The deadbolt member is connected by means of a connecting fork 44 to an actuating mechanism generally referred to by reference numeral 48, the mechanism 48 being associated with the key operated lock mechanism 24 and knob 22 through which the actuating shaft 36 is rotated between the operative positions denoted by the markings 28, 30 and 32 as aforementioned. In this illustrated embodiment, the actuating mechanism includes an axial cam member 50 secured to the shaft 36 having a cam groove 52 within which a cam follower element 54 is engaged. The cam follower element is connected by means of an adjustable screw coupling device 56 to the fork 44. It will therefore be apparent that rotation of the actuating shaft 36 will be operative through the cam groove 52 to effect displacement of the deadbolt member 42 between the locking position more clearly seen in FIGS. 4 and 5 to the retracted position shown in FIG. 6 and the latch release position shown in FIG. 7.

The tubular dead bolt member 42 is provided with an opening 58 at one axial end opposite the axial end to which the fork 44 is connected and through which the longitudinal axis of the deadbolt extends. Mounted within the deadbolt is a latching device generally referred to by reference numeral 60 in accordance with the embodiment of the invention shown in FIGS. 1–9. The latch device 60 includes a pair of pivoted jaws 62 pivotally connected to the deadbolt member through a pivot pin 64 through which the fork 44 is connected to the deadbolt member. The pivoted jaws 62 are biased to a closed gripping position by an elastic O-ring element 66 seated within grooves 68 formed in the jaws. The jaws are provided with staggered, confronting teeth 70. When the deadbolt member is retracted to the position shown in FIG. 7 as denoted by the marking 32 on escutcheon 34, the pivoted jaws are displaced to the open position by a latch releasing abutment element 72 mounted in an adjustably fixed position within the tubular housing 36 of the lock mechanism. The abutment element 72, as more clearly seen in FIGS. 4 and 5, is connected by a threaded shank 74 to a cross-piece element 76 fixed to the tubular housing 36 and extending transversely thereof between the arms of the fork member 44. The axial position of the abutment element 72 may be adjusted precisely by rotation of the threaded shank 74 in order to open the jaws 62 at the desired axial position of the deadbolt member 42.

The deadbolt member when displaced to its extended locking position as shown in FIGS. 4 and 5, is received within a recess 78 formed in a jamb mounted housing 80 between a strike plate 82 and a guide plate 84 secured to the housing internally thereof in axially spaced relation to the strike plate 82. A storage chamber 86 is also formed within the housing 80 for a coiling tyoe of flexibly elastic tape 88 anchored to and rotatably mounted on shaft 90 in the housing storage chamber 86. The tape 88 is thereby adapted to be extended through an opening in the guide plate 84 aligned with the opening 58 at the end of the deadbolt member 42 when received within the recess 78. The end of the tape 88 withdrawn from the storage chamber 86 is connected to a relatively rigid coupling plate element 92 provided with spaced slots through which the teeth 70 on the pivoted jaws 62 project as shown in FIGS. 4 and 5 in order to withdraw the tape from the jamb mounted housing as shown in FIG. 6. The coupling element 92 at its tape end is shouldered to abut the guide plate 84 and limit its retraction to a position within recess 78 of the housing 80. The jamb mounted housing is secured to the jamb through its strike plate 82 by means of flathead screw fasteners 94 as more clearly seen in FIG. 5.

Figure 11:
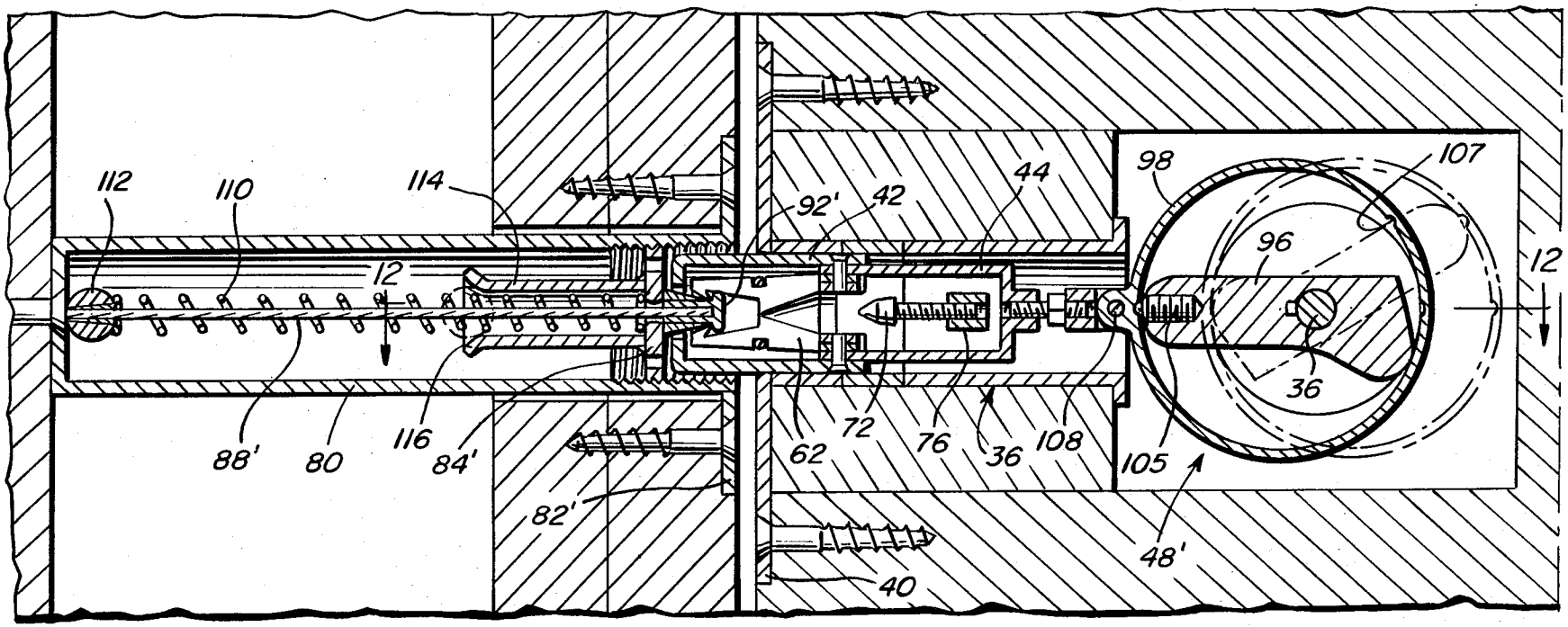
FIG. 11 is a horizontal section view corresponding to that of FIG. 4 showing a lock assembly in accordance with the embodiment of the invention shown in FIG. 10.

FIGS. 10–14 illustrate another embodiment of the invention which is similar to the embodiment illustrated in FIGS. 1–9 in providing a tubular deadbolt member 42 connected by a fork 44 to a modified form of actuating mechanism generally referred to by reference numeral 48', the deadbolt member being slidably displaceable within a similar tubular housing 36 secured through a face plate 40 to the edge of the door as more clearly seen in FIG. 11. The actuating mechanism 48' is driven through the same actuating shaft 36 and includes a carrier arm 96 in bearing contact at two circumferentially spaced points within an annular groove 100 of an eccentric ring 98 having internal orbit gear teeth 102. A planet gear 104 is in mesh with the orbit gear teeth and is rotatably mounted by a pin 106 on the carrier arm 96 as more clearly seen in FIG. 10. The ring 98 is pivotally connected by pin 108 and an adjustable coupling 56' to the actuating fork 44. Thus, rotation of the shaft 36 will be transmitted to the deadbolt 42 as slidable movement. A yieldable detent 105 carried on arm 96 as shown in FIG. 11 is engageable with internal notches 107 in the ring 98 at circumferentially spaced locations corresponding to the locking, retracted and latch release position of the deadbolt as aforementioned. The arms of the actuating fork also straddle a fixed transverse cross piece element 76 to which a latch releasing abutment element 72 is connected in an axially adjusted position as aforementioned in connection with the first described embodiment of the invention.

The latch releasing abutment element 72 is engageable with a pair of pivoted jaws 62' biased to a closed gripping position as hereinbefore described with respect to the pivoted jaws 62 of latch device 60. The pivoted jaws 62' are, however, provided with arcuate teeth 70' as more clearly seen in FIGS. 12 and 13 to engage a coupling element 92' secured to one end of a cable type of flexible guard element 88' associated with the jamb-mounted hardware.

The jamb mounted hardware includes a tubular strike housing 80' having an open axial end to which strike plate 82' is secured. The housing is internally threaded at the opened axial end for adjustable positioning of a guide plate 84' having an opening through which the flexible guard cable 88' extends. As in the case of the first described embodiment, a coupling element 92' abuts the guide plate 84' when the cable is retracted as shown in FIG. 11 in order to limit its inward displacement. The cable 88' is retracted under the bias of an elongated coil spring 110 which reacts between a ball type anchor element 112 secured to one end of the cable 88' and the guide plate 84'. Both the coil spring 110 and cable extend into a guide tube 114 which is secured to an extends inwardly from the guide plate 84'. The inward end 116 of the guide tube is flared outwardly to form an abutment for the ball anchor element 112 to thereby limit the extension of the flexible guard cable 88' from the jamb mounted portion of the lock assembly as shown in FIG. 14.

Figures 12, 13, 14, 15, 16, 17:
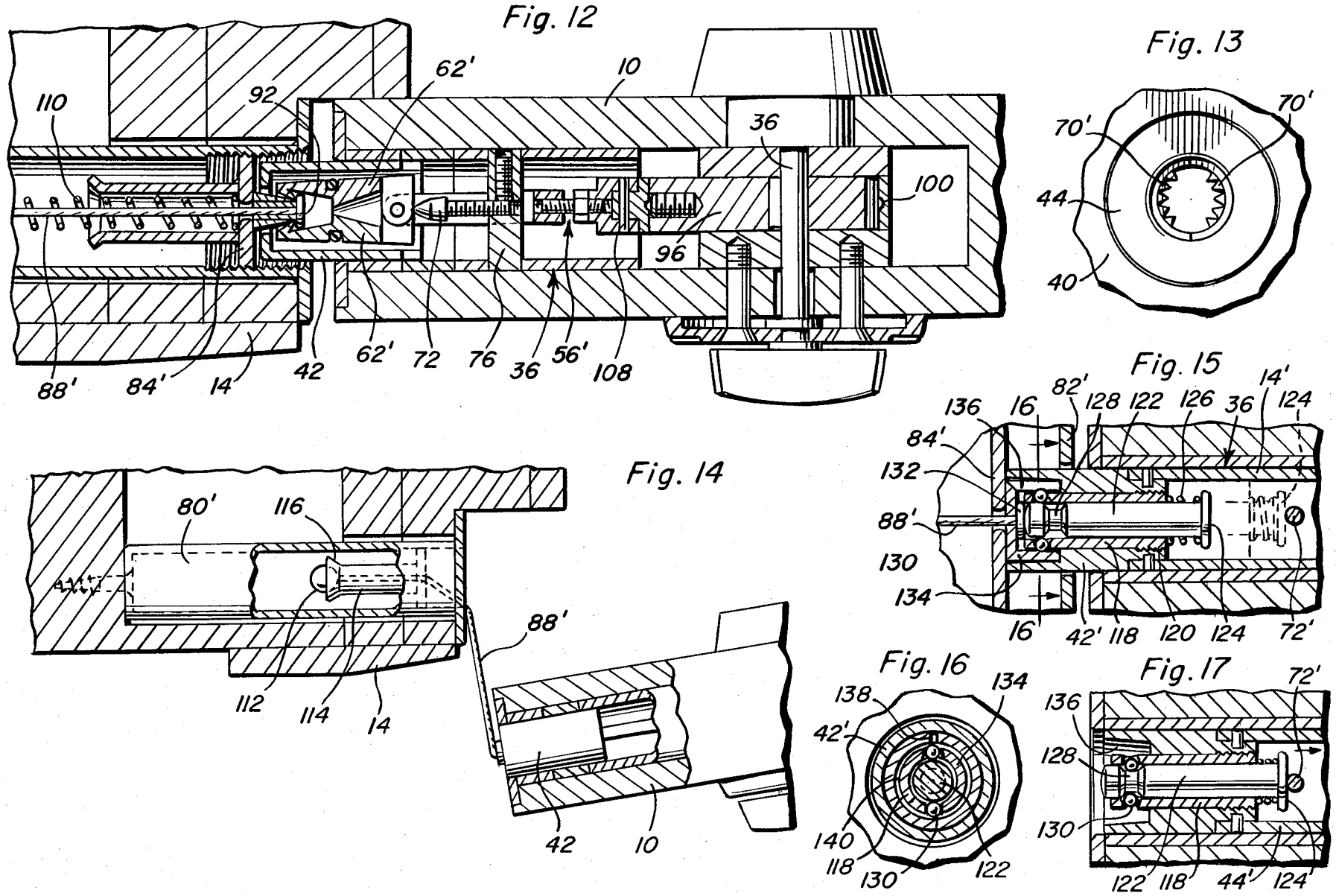
FIG. 12 is a section view taken substantially through a plane indicated by section line 12—12 in FIG. 11.
FIG. 13 is a partial end elevation view of the door edge showing the door mounted hardware in accordance with the embodiment of FIGS. 9–12.
FIG. 14 is a partial section view corresponding to FIG. 6 showing the door open to a limited extent with hardware constructed in accordance with the second embodiment of the invention shown in FIG. 9–13.
FIG. 15 is a partial vertical section view through a door lock assembly in accordance with a third embodiment of the invention.
FIG. 16 is a partial transverse section view taken substantially through a plane indicated by section line 16—16 in FIG. 15.
FIG. 17 is a vertical partial section view through the lock assembly shown in FIGS. 15 and 16 with the door opened and the flexible guard element released.

FIGS. 15, 16 and 17 illustrate another embodiment of the invention involving a modification of the deadbolt member and the latch device carried therein. As shown in FIG. 15, a deadbolt member 42' has a bore formed therein to receive a sleeve 118 internally fixed to the deadbolt member at a knurled end portion 120. The sleeve 118 forms a slide bearing for an elongated lock pin 122 having a flange 124 at one axial end and engaged by a coil spring 126 biasing the lock pin to a locking position as shown in FIG. 15. The lock pin has a camming groove 128 formed therein to control the locking action of ball elements 130 of the latching device, the ball elements being caged within openings 132 formed in the sleeve 118 for such purpose. The flexible guard cable 88' is secured in any suitable fashion to a cup shaped coupling element 134 adapted to be received within a countersunk latch chamber 136 formed in the deadbolt member 42. The ball elements 130 are axially positioned within chamber 136 by the sleeve 118. The coupling element 134 is made yieldable by a gap 138 in its cylindrical wall, as more clearly seen in FIG. 16, in order to accomodate its coupling to the sleeve 118 by means of balls 130 projecting radially therefrom as shown in FIG. 15. The coupling element 134 has an annular groove 140 formed therein for engagement by the ball elements 130 when the deadbolt member 42' is projected into the recess formed between the strike plate 82' and the guide plate 84' constituting part of the jamb mounted hardware as described in connection with FIGS. 9–14.

The deadbolt member 42' is displaced from the locking position as shown by solid line in FIG. 15 by the actuating mechanism through a fork 44' to a retracted position as shown by dotted line wherein the flange 124 on the lock pin 122 barely contacts a release pin 72' fixed to the dead bolt housing 36 and extending transversely therethrough. In this retracted position of the dead bolt member 42', the cable 88' remains latched to the dead bolt member in order to limit opening of the door as hereinbefore described with respect to the other two embodiments of the invention. When the dead bolt member is further retracted to a release position as shown in FIG. 17, the flange 124 on the lock pin abuts the release pin 72' to compress the spring 126 and forwardly project the lock pin relative to the sleeve 118 as shown. The groove 128 in the lock pin is then aligned with the ball elements 130 so that they may be retracted radially inwardly to release the coupling element 134 on the cable 88'. The flexible guard cable 88' will then be released and retracted into the jamb-mounted hardware as hereinbefore described with respect to FIGS. 9–14. Reengagement of the latch device formed by the lock pin 122, sleeve 118 and ball elements 130 is made possible as soon as the deadbolt member 42' is displaced outwardly from its release position shown in FIG. 17.

FIGS. 18–21 illustrate yet another embodiment wherein the jamb mounted hardware of the type shown in FIGS. 12 and 14 is modified to incorporate a panic alarm system. A flexible guard cable 142 extends from a tubular strike housing 144 internally threaded at its open end for mounting a guide tube 146, within which a telescoping slide tube 148 is mounted. An override coil spring 150 engages annular abutments 152 and 154 projecting internally from the strike housing 142 and slide tube 148 to exert an axial bias on the slide tube. An opposing axial bias is exerted on slide tube 148 by a retraction spring 149 reacting at its opposite ends on the abutment 154 and a ball anchor element 156 from which cable 142 extends through the tubes 148 and 146 to a coupling element 134 received in a recess of the strike housing as described with respect to FIGS. 15 and 16.

Figure 18:
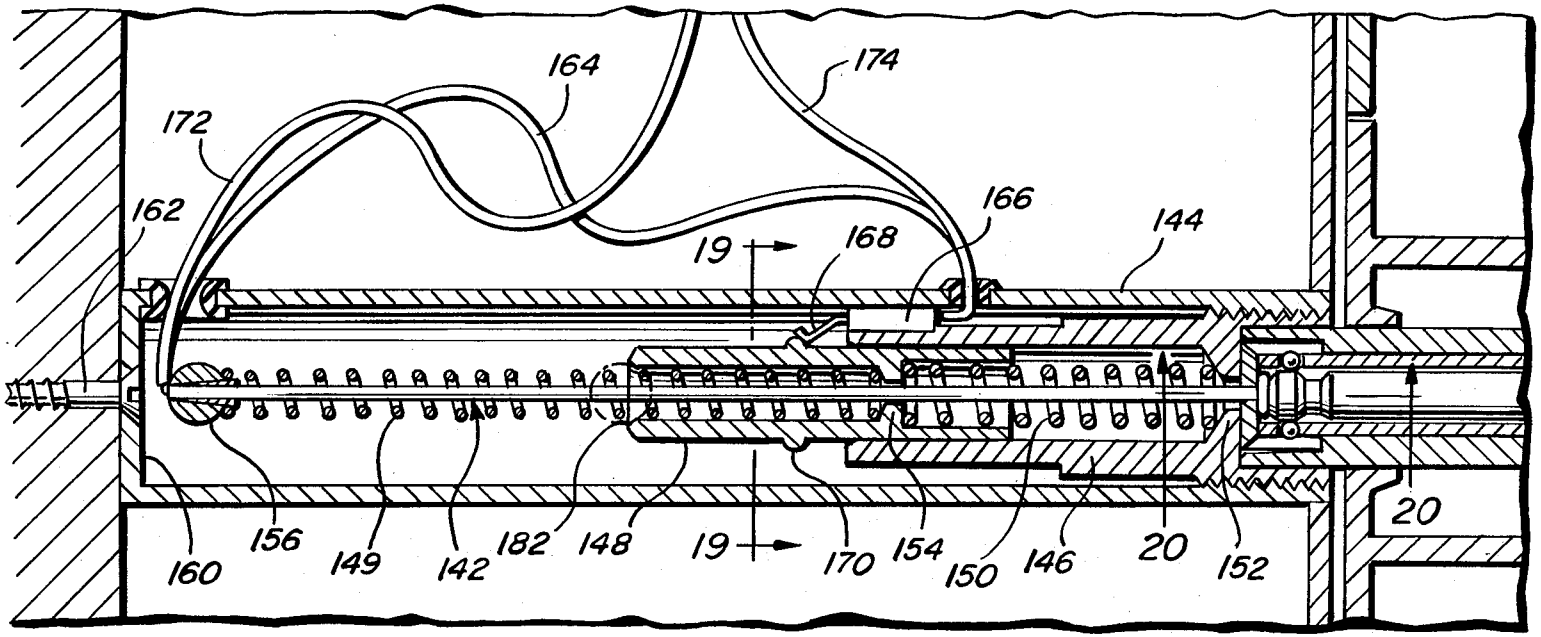
FIG. 18 is a partial side sectional view showing yet another embodiment of the invention.
Figure 20:
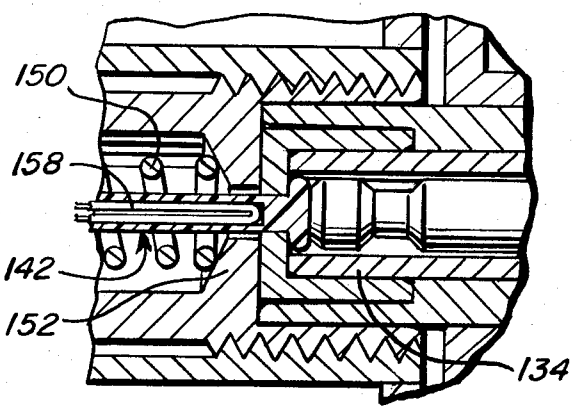
FIG. 20 is an enlarged partial sectional view taken substantially through a plane indicated by section line 20—20 in FIG. 18.
Figure 19:
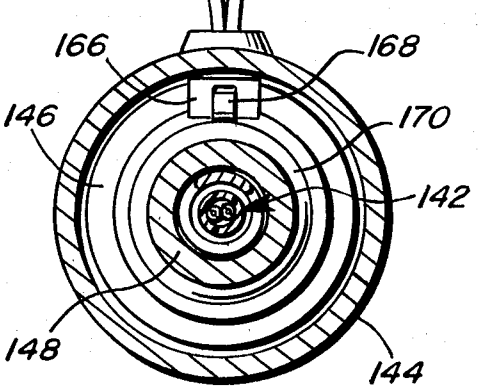
FIG. 19 is an enlarged transverse sectional view taken substantially through a plane indicated by section line 19—19 in FIG. 18.

As more clearly seen in FIG. 20, the cable 142 encloses a conductor loop 158. The conductors of the loop extend from anchor element 156 through a grommeted opening in the strike housing adjacent its inner end wall 160 secured by fastener 162 to the door framing structure, as shown in FIG. 18. One of the conductors 164 connected to loop 158 extends into the housing 144 through another grommeted opening for connection to a micro-switch sensor 166 fixedly mounted on the tube 146. An actuator arm 168 extends from the sensor 166 onto the external surface of tube 148 in close adjacency to an actuating projection 170 on the slide tube 148. Another of the loop conductors 172 extends from anchor element 156 to a power source, while a conductor 174 extends from sensor 166 to an alarm circuit such as that shown in FIG. 21, by way of example.

Figure 21:
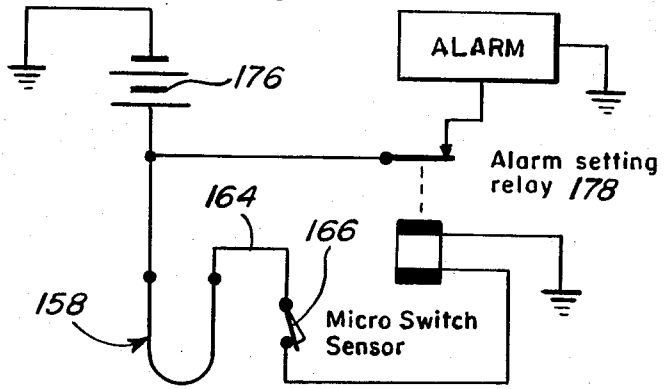
FIG. 21 is a simplified electric circuit diagram of the alarm system associated with the embodiment shown in FIGS. 18–20.

As shown in FIG. 21, conductor 172 is connected to a source of voltage 176, while conductor 174 is connected to the relay coil of a normally energized alarm setting relay 178. The micro-switch sensor 166 is normally closed to maintain the relay coil energized and hold its relay switch open. Actuation of switch 166 will therefore deenergize the relay 178 to close its relay switch and connect the voltage source to alarm device 180 for operation thereof. Alarm operation will also be triggered by any break in the conductor loop 158 or conductors 164, 172 and 174 by causing deenergization of relay 178. The conductor loop 158 is relatively frangible because of its exposure to impact forces adjacent coupling element 134 and would rupture should there be a forced entry attempt causing impact on the door jamb adjacent the strike housing 144. Any cutting of the cable 142 or the conductors 164, 172 and 174 in an effort to disable the alarm would also trigger the alarm. Further, any excessive pull on cable 148 when extended will cause anchor element 156 to abut the end 182 of the slide tube 148 as shown by dotted line in FIG. 18 causing displacement of the slide tube against the bias of spring 150, which is substantially heavier than that of cable retracting spring 149. Such axial displacement of slide tube 148 from its static position as shown in FIG. 18 will actuate sensor switch 166 to trigger the alarm circuit as described.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a security door lock assembly comprising a relatively movable, door-mounted portion, a relatively stationary jamb-mounted portion adapted for cooperation with said movable portion, a flexible guard element, means yieldably retracting the element inwardly into said stationary portion, strike plate means having a recess in the stationary portion through which the guard element is extended externally of the stationary portion, coupling means fixed to the element and seated within the recess of the strike plate means to limit the retraction of the element inwardly into the stationary portion, latch means mounted in the movable portion and projected into the recess for latching engagement with the coupling means, and manually operable means mounted on the movable portion to selectively release the latch means from engagement with the coupling means, the improvement comprising a deadbolt mounted in the movable portion and displaceable by the manually operable means into the recess of the strike plate means, means mounting the latch means within the deadbolt for said projection into the recess, and means responsive to retraction of the deadbolt into the movable portion by the manually operable means for effecting said selective release of the latch means.

2. The improvement as defined in claim 1 wherein the deadbolt is provided with an opening through which the coupling means passes into engagement with the latch means internally of the deadbolt.

3. The improvement as defined in claim 2 wherein the latch means comprises a pair of pivoted jaws biased to a gripping position.

4. The improvement as defined in claim 3 wherein the retraction responsive latch release means comprises an abutment element fixedly mounted within the movable portion and engageable with the pivoted jaws.

5. The improvement as defined in claim 4 including actuating means operatively connecting the manually operable means to the deadbolt for displacement thereof from a locking position within the recess to retracted and latch release positions in sequence.

6. The improvement as defined in claim 5 including detent means for yieldably holding the actuating means in each of said locking, retracted and latch release positions.

7. The improvement as defined in claim 6 wherein the actuating means comprises a cam connected to the manually operable means and rotatable therewith between said locking, retracted and latch release positions, and a follower element connected to the deadbolt and engageable with the cam.

8. The improvement as defined in claim 6 wherein the actuating means comprises a rotatable carrier arm connected to the manually operable means and rotatable therewith between said locking, retracted and latch release positions, an orbit gear disposed in eccentric relation to the carrier arm and pivotally connected to the deadbolt, and a planet gear rotatably mounted on the carrier arm in mesh with the orbit gear.

9. The improvement as defined in claim 8 wherein said detent means comprises circumferentially spaced notches formed in the orbit gear and spring biased ball means mounted on the carrier arm for reception within said notches.

10. The improvement as defined in claim 1 wherein the latch means comprises a pair of pivoted jaws biased to a gripping position.

11. The improvement as defined in claim 10 wherein the retraction responsive latch release means comprises an abutment element fixedly mounted within the movable portion and engageable with the pivoted jaws.

12. The improvement as defined in claim 1 including actuating means operatively connecting the manually operable means to the deadbolt for displacement thereof from a locking position within the recess to retracted and latch release positions in sequence.

13. The improvement as defined in claim 12 including detent means for yieldably holding the actuating means in each of said locking, retracted and latch release positions.

14. The improvement as defined in claim 13 wherein the actuating means comprises a rotatable carrier arm connected to the manually operable means and rotatable therewith between said locking, retracted and latch release positions, an orbit gear disposed in eccentric relation to the carrier arm and pivotally connected to the deadbolt, and a planet gear rotatably mounted on the carrier arm in mesh with the orbit gear.

15. The improvement as defined in claim 14 wherein said detent means comprises circumferentially spaced notches formed in the orbit gear and spring biased ball means mounted on the carrier arm for reception within said notches.

16. The improvement as defined in claim 12 wherein the actuating means comprises a cam connected to the manually operable means and rotatable therewith between said locking, retracted and latch release positions, and a follower element connected to the deadbolt and engageable with the cam.

17. The improvement as defined in claim 1 wherein said flexible guard element is a recoil tape and said coupling means is a relatively rigid plate having spaced slots therein through which the latch means engages the coupling means.

18. The improvement as defined in claim 17 wherein the strike plate means comprises a housing having an open end into which the deadbolt is projected, and a guide plate fixed within the housing and spaced inwardly of the open end to define said recess, the guide plate being formed with an opening through which the flexible guard element passes.

19. The improvement as defined in claim 18 wherein the rigid plate is formed with a stop shoulder abutting the guide plate to limit said retraction of the guard element.

20. The improvement as defined in claim 1 wherein the strike plate means comprises a housing having an open end into which the deadbolt is projected, and a guide plate fixed within the housing and spaced inwardly of the open end to define said recess, the guide plate being formed with an opening through which the flexible guard element passes.

21. The improvement as defined in claim 20 wherein the rigid plate is formed with a stop shoulder abutting the guide plate to limit said retraction of the guard element.

22. The improvement as defined in claim 20 wherein the flexible guard element is an elongated cable having opposite ends, an anchor element connected to one of the ends of the cable, the coupling means being connected to the other of the ends of the cable, said yieldable retracting means comprising a coil spring reacting between the guide plate and the anchor element, and a guide tube secured to the guide plate and into which the cable and the coil spring extend, the guide tube having an end portion engageable with the anchor element to limit extension of the flexible guard element from the stationary jamb-mounted portion.

23. In a securing door lock assembly comprising a relatively movable, door-mounted portion, a relatively stationary jamb-mounted portion adapted for cooperation with said movable portion, a flexible guard element, means yieldably retracting the element inwardly into said stationary portion, strike plate means having a recess in the stationary portion through which the guard element is extended, coupling means fixed to the element and seated within the recess of the strike plate means to limit the retraction of the element inwardly into the stationary portion, latch means mounted in the movable portion and projected into the recess for latching engagement with the coupling means, and manually operable means mounted on the movable portion for selectively releasing the latch means from engagement with the coupling means, the improvement comprising a deadbolt having a longitudinal axis, actuating means operatively connecting the manually operable means to the deadbolt for displacement thereof substantially parallel to the longitudinal axis into the recess of the strike plate means, means mounting the latch means on the deadbolt in alignment with said longitudinal axis for projection into the recess to engage the coupling means therein, and means responsive to retraction of the deadbolt into the movable portion by the actuating means to a release position for effecting said selective release of the latch means.

24. The improvement as defined in claim 23 wherein the deadbolt is provided with an opening through which the coupling means passes into engagement with the latch means internally of the deadbolt.

25. The improvement as defined in claim 23 wherein the latch means comprises an elongated lock pin having an annular camming groove formed therein, a sleeve slidably mounting the lock pin within the deadbolt, means for biasing the lock pin to a latching position, said deadbolt having a latch chamber within which the coupling means is received, and at least one ball element mounted by the sleeve within the latch chamber, said coupling means being engageable by the ball element to couple the flexible guard element to the deadbolt through the sleeve when the ball element is out of alignment with the camming groove in the latching position of the lock pin.

26. The improvemsnt as defined in claim 23 including sensing means for detecting excessive pull on the flexible guard element, an alarm device, and conductor means connecting the sensing means to the alarm device for operation thereof in response to said detection of excessive pull.

27. The improvement as defined in claim 26 wherein said conductor means includes frangible loop means within the flexible guard element for triggering operation of the alarm device in response to rupture.

28. In a security door lock assembly comprising a relatively movable, door-mounted portion, a relatively stationary jamb-mounted portion adapted for cooperation with said movable portion, a flexible guard eiement, a strike housing mounted in the stationary portion and having a recess, coupling means fixed to the guard element and seated within the recess of the strike housing to limit retraction of the guard element inwardly into the stationary portion, latch means mounted in the movable portion and projected into the recess for latching engagement with the coupling means, and manually operable means mounted on the movable portion for selectively releasing the latch means from engagement with the coupling means, the improvement comprising sensing means for detecting excessive force applied, an alarm device, and conductor means connecting the sensing means to the alarm device for operation thereof in response to said detection of excessive force.

29. The improvement as defined in claim 28 wherein said conductor means includes frangible loop means within the flexible guard element for triggering operation of the alarm device in response to rupture by said excessive force.

30. The improvement as defined in claim 29 wherein the sensing means includes a guide tube fixedly connected to the strike housing, a slide tube telescopingly received in the guide tube, centering spring means for yieldably holding the slide tube in a static position from which the slide tube is displaced in response to an excessive pull on the guard element, and displacement sensing switch means mounted on the guide tube for detecting said displacement of the slide tube from the static position to trigger operation of the alarm device.

31. The improvement as defined in claim 30 wherein the flexible guard element is an elongated cable having opposite ends and anchor means connected to one of the ends of the cable for retraction thereof by the centering spring means, the coupling means being connected to the other of the ends of the cable.

32. The improvement as defined in claim 28 wherein the sensing means includes a guide tube fixedly connected to the strike housing, a slide tube telescopingly received in the guide tube, centering spring means for yieldably holding the slide tube in a static position from which the slide tube is displaced in response to said excessive force applied to the flexible guard element, and displacement sensing switch means mounted on the guide tube for detecting said displacement of the slide tube from the static position.

33. The improvement as defined in claim 32 wherein the flexible guard element is an elongated cable having opposite ends, and anchor means connected to one of the ends of the cable for retraction thereof by the centering spring means, the coupling means being connected to the other of the ends of the cable.

* * * * *

UNITED STATES PATENT AND TRADEMARK OFFICE

CERTIFICATE OF CORRECTION

PATENT NO. : 4,493,500

DATED : January 15, 1985

INVENTOR(S) : LARRY J. STROUP

It is certified that error appears in the above-identified patent and that said Letters Patent is hereby corrected as shown below:

On the title page, line item [22] is corrected to read --Filed: Mar. 23, 1983--.

Signed and Sealed this

*Twenty-eighth* Day of *May 1985*

[SEAL]

*Attest:*

DONALD J. QUIGG

*Attesting Officer*

*Acting Commissioner of Patents and Trademarks*